US011338172B2

(12) United States Patent
Vujicic et al.

(10) Patent No.: US 11,338,172 B2
(45) Date of Patent: May 24, 2022

(54) TREADMILL WITH RESTRAINT DEVICE

(71) Applicant: YITRON TECHNOLOGY COMPANY LIMITED, Chiayi (TW)

(72) Inventors: Marko Vujicic, Tustin, CA (US); Greg Wallace, Tustin, CA (US)

(73) Assignee: Yitron Technology Company Limited, Chiayi (TW)

( * ) Notice: Subject to any disclaimer, the term of this patent is extended or adjusted under 35 U.S.C. 154(b) by 0 days.

(21) Appl. No.: 17/079,256

(22) Filed: Oct. 23, 2020

(65) Prior Publication Data

US 2021/0121737 A1 Apr. 29, 2021

Related U.S. Application Data

(60) Provisional application No. 62/927,029, filed on Oct. 28, 2019, provisional application No. 62/927,023, filed on Oct. 28, 2019.

(51) Int. Cl.

| | |
|---|---|
| ***A63B 22/02*** | (2006.01) |
| ***A63B 21/00*** | (2006.01) |
| ***A63B 22/00*** | (2006.01) |
| ***A63B 21/015*** | (2006.01) |

(52) U.S. Cl.

CPC ..... *A63B 22/0285* (2013.01); *A63B 21/015* (2013.01); *A63B 21/15* (2013.01); *A63B 22/0046* (2013.01)

(58) Field of Classification Search

CPC ..... A63B 21/15; A63B 2071/0658; A63B 2022/0271; A63B 2022/0278; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 22/04; A63B 22/06; A63B 71/0619; A63B 2069/0031; A63B 2069/0033; A63B 2022/067; A63B 2022/0676; A63B 2022/0682; A63B 2022/0688; A63B 2022/206; A63B 69/0028

USPC ..... 482/54

See application file for complete search history.

(56) References Cited

U.S. PATENT DOCUMENTS

| | | | | |
|---|---|---|---|---|
| 2012/0010048 | A1* | 1/2012 | Bayerlein | A63B 22/0235 482/54 |
| 2018/0001134 | A1* | 1/2018 | Bayerlein | A63B 22/0235 |
| 2019/0083844 | A1* | 3/2019 | Bayerlein | A63B 69/0057 |
| 2019/0118030 | A1* | 4/2019 | Yoo | A63B 22/0046 |

(Continued)

*Primary Examiner* — Megan Anderson
*Assistant Examiner* — Thao N Do
(74) *Attorney, Agent, or Firm* — Trojan Law Offices

(57) ABSTRACT

The present invention provides a manual treadmill, the manual treadmill includes a frame having a front support portion and a rear support portion, a running belt disposed about and supported by the front support portion and the rear support portion, and a speed limiting device, wherein the running belt rotates in a first rotating direction or a second rotating direction in response to a directional movement of a user. The speed limiting device includes a one-way bearing, a rotating element and a transmission element, wherein the rotating element is coupled to the front support portion, and the one-way bearing is connected to the rotating element via the transmission element to limit a speed of the running belt in the second rotating direction.

20 Claims, 20 Drawing Sheets

(56) References Cited

U.S. PATENT DOCUMENTS

| | | | | |
|---|---|---|---|---|
| 2019/0168067 | A1* | 6/2019 | Bates | A63B 22/02 |
| 2019/0314674 | A1* | 10/2019 | Chen | A63B 22/20 |
| 2019/0381348 | A1* | 12/2019 | Tsai | A63B 22/02 |
| 2020/0030659 | A1* | 1/2020 | Xing | A63B 21/0051 |
| 2020/0254302 | A1* | 8/2020 | Yoo | A63B 22/0235 |
| 2021/0121737 | A1* | 4/2021 | Vujicic | A63B 22/0285 |
| 2021/0197013 | A1* | 7/2021 | Meng | A63B 23/03558 |

* cited by examiner

1

TREADMILL WITH RESTRAINT DEVICE

CROSS-REFERENCE TO RELATED APPLICATION AND CLAIM OF PRIORITY

This application claims priority to U.S. Provisional Patent Applications No. 62/927,023 and No. 62/927,029 filed on Oct. 28, 2019, which are incorporated herein in their entirety by reference.

FIELD OF THE INVENTION

The present invention is related to a treadmill. In particular, the present invention is related to a slat-belt treadmill with a restraint device.

BACKGROUND OF THE INVENTION

Treadmills are common fitness equipment in gyms or homes, which enable users to walk, jog, or run for a long distance in a limited space. The user's movement on the treadmill generates a force to propel him or herself in a desired direction (generally forward). As the user's feet touch the ground (or other surface), the muscles contract and apply a backward force to the ground, which is a direction substantially opposite the direction he desires to move. According to Newton's third law of motion, the ground resists the backward force from the user, causing the user to move forward relative to the ground at a speed related to the backward force.

To counteract the force generated by the user on the treadmill and allow the user to stay in a relatively static fore and aft position on the treadmill, most treadmills utilize a belt driven by a motor. The motor operatively applies a rotational force to the belt, causing the portion of the belt on which the user is standing to move roughly backward. This rotational force must be sufficient to overcome all sources of friction, such as friction between the belt and other treadmill components in contact therewith and kinetic friction, to rotate the belt at a desired speed. It should be noted that the belts of traditional treadmills driven by a motor must overcome many significant sources of friction because of the presence of the motor and the configurations of the treadmills themselves.

The desired net effect of the design of the treadmill is that, when the user is positioned on the running surface of the belt, the forward velocity achieved by the user and the backward velocity of the belt are substantially balanced. In other words, the belt moves at substantially the same speed as the user, but in the opposite direction. In this way, the user can remain at substantially the same relative position along the treadmill while running.

Similar to a treadmill powered by a motor, a manual treadmill must also include some systems or means to absorb or counteract the forward velocity generated by the user, so that the user may generally maintain a substantially static position on the running surface of the treadmill. Therefore, in the manual treadmill, the force driving the belt must be sufficient to move the belt at substantially the same speed as the user, so that the user stays in roughly the same static position on the running surface. However, unlike electric treadmills, this force is not provided by a motor.

In addition, another important point that needs to be considered in the design of treadmills is safety. The running belt of the treadmill will move in response to the user's movements thereon (such as standing on the treadmill, leaving the treadmill, or running on the treadmill), and the arc design of the curved running belt can enable the user to accelerate or slow down his speed of the forward movement, so it is necessary to ensure that the user is safe under any action. For example, at the moment that the user stands on the treadmill with one foot at the rear end of the treadmill, the user may lose balance if the curved running belt can slide forward easily. A treadmill that lacks a safe design will produce an unpleasant experience and cause users to be injured.

The running belt of a slat-belt treadmill is composed of slats to withstand the weight of the user on the running belt and the impact on the running belt during exercise, and these forces are usually loaded on top of the center portion of each slat, so that the slat will have to endure downward deflection when both sides of the slat are supported by bearings. Under this deflection state, most of the stress on the slat is concentrated in the middle section of the slat, which easily causes the slat to be broken. Therefore, there is a need for a slat structure that can uniformly disperse the stress on the running belt.

SUMMARY OF THE INVENTION

In order to effectively resolve the above-mentioned issues of the prior art, the present invention provides a treadmill with a restraint device. When the user runs on the treadmill, he or she can remain at substantially the same relative position, and the safety of users on the treadmill can be ensured by the restraint device.

The present invention discloses a manual treadmill, which includes: a frame having a front support portion and a rear support portion, a running belt disposed about and supported by the front support portion and the rear support portion, and a speed limiting device, wherein the running belt rotates in a first rotating direction or a second rotating direction in response to a directional movement of a user. The speed limiting device includes a one-way bearing, a rotating element and a transmission element, wherein the rotating element is coupled to the front support portion, and the one-way bearing is connected to the rotating element via the transmission element to limit a speed of the running belt in the second rotating direction.

The present invention further discloses a manual treadmill, which includes a frame having a front support portion and a rear support portion, a running belt disposed about and supported by the front support portion and the rear support portion, and a restraint device, wherein the running belt rotates in a first rotating direction by a first force applied by a user from the front support portion toward the rear support portion, and rotates in a second rotating direction by a second force applied by the user from the rear support portion toward the front support portion. The restraint device includes a one-way bearing, a rotating element pulley and a transmission element, wherein the rotating element is coupled to the front support portion, the one-way bearing is connected to the rotating element via the transmission element, and the restraint device provides a restraint force to the front support portion when the running belt is to rotate in the second rotating direction, to restrain a rotation of the running belt in the second rotating direction.

The present invention further discloses a slat-belt treadmill, wherein the slat-belt treadmill includes a frame having a front support portion and a rear support portion, and a running belt disposed about and supported by the front support portion and the rear support portion, wherein the running belt rotates in a first rotating direction or a second rotating direction. The restraint device includes a rotating element disposed on one of the front support portion and the rear support portion, and rotated with the running belt, a one-way bearing fixed on the frame and rotated only in the first rotating direction, and a transmission element connected to the rotating element and the one-way bearing, wherein the rotating element in a first instance is stopped from rotating in the second rotating direction by the one-way bearing, or in a second instance subjects to a specific restraint force in the second rotating direction when the running belt is to rotate in the second rotating direction.

Another aspect of the present invention is to provide a slat structure suitable for slat-belt treadmills. This slat has a reinforced structure that is not easily deformed or broken, and is beneficial to the rotation of the slat-belt.

The present invention further discloses a running belt of a treadmill configured to allow an exercise of a user thereon, the running belt includes a plurality of slats attached in parallel one by one and adjacent to one another to commonly form the running belt, wherein each of the plurality of slats includes a body, at least two strengthening pieces and a bottom piece. The body is a long strip and has two ends and a longitudinal direction. The at least two strengthening pieces are disposed on a bottom of the body substantially along the longitudinal direction, and each strengthening piece has a first longitudinal side connected to the bottom and an opposite second longitudinal side, to assist the body to bear a force applied by the user. The bottom piece is used for connecting the opposite second longitudinal side of each strengthening piece, to disperse the stresses on the body, the at least two strengthening pieces and the bottom piece along the longitudinal direction due to the force.

The present invention further discloses a running belt of a treadmill configured to allow a movement of a user thereon, the running belt includes a plurality of slats attached in parallel one by one and adjacent to one another to commonly form the running belt, wherein each of the plurality of slats includes a body and a hollow beam. The body is a long strip and has two ends. The hollow beam protrudes downward from the body and extends in parallel between the two ends of the body, to assist the body to bear a force applied by the user.

Other objective, advantages and efficacies of the present invention will be described in detail below taken from the preferred embodiments with reference to the accompanying drawings.

BRIEF DESCRIPTION OF THE DRAWINGS

The objectives and advantages of the present invention will become more readily apparent to those ordinarily skilled in the art after reviewing the following detailed descriptions and accompanying drawings.

DETAILED DESCRIPTION OF THE PREFERRED EMBODIMENTS

The present invention will now be described more specifically with reference to the following embodiments. It is to be noted that the following descriptions of the preferred embodiments of this invention are presented herein for purpose of illustration and description only; they are not intended to be exhaustive or to be limited to the precise form disclosed.

The foregoing and other technical content, features and effects of the present invention will be clearly presented in the detailed descriptions of multiple embodiments below with reference to the drawings. In addition, the terms "running" and "movement" used in this disclosure refer to all movements of the user on the treadmill substantially relative to the moving direction of the running belt, including but not limited to jogging, walking, sprinting, etc.

Figure 1:
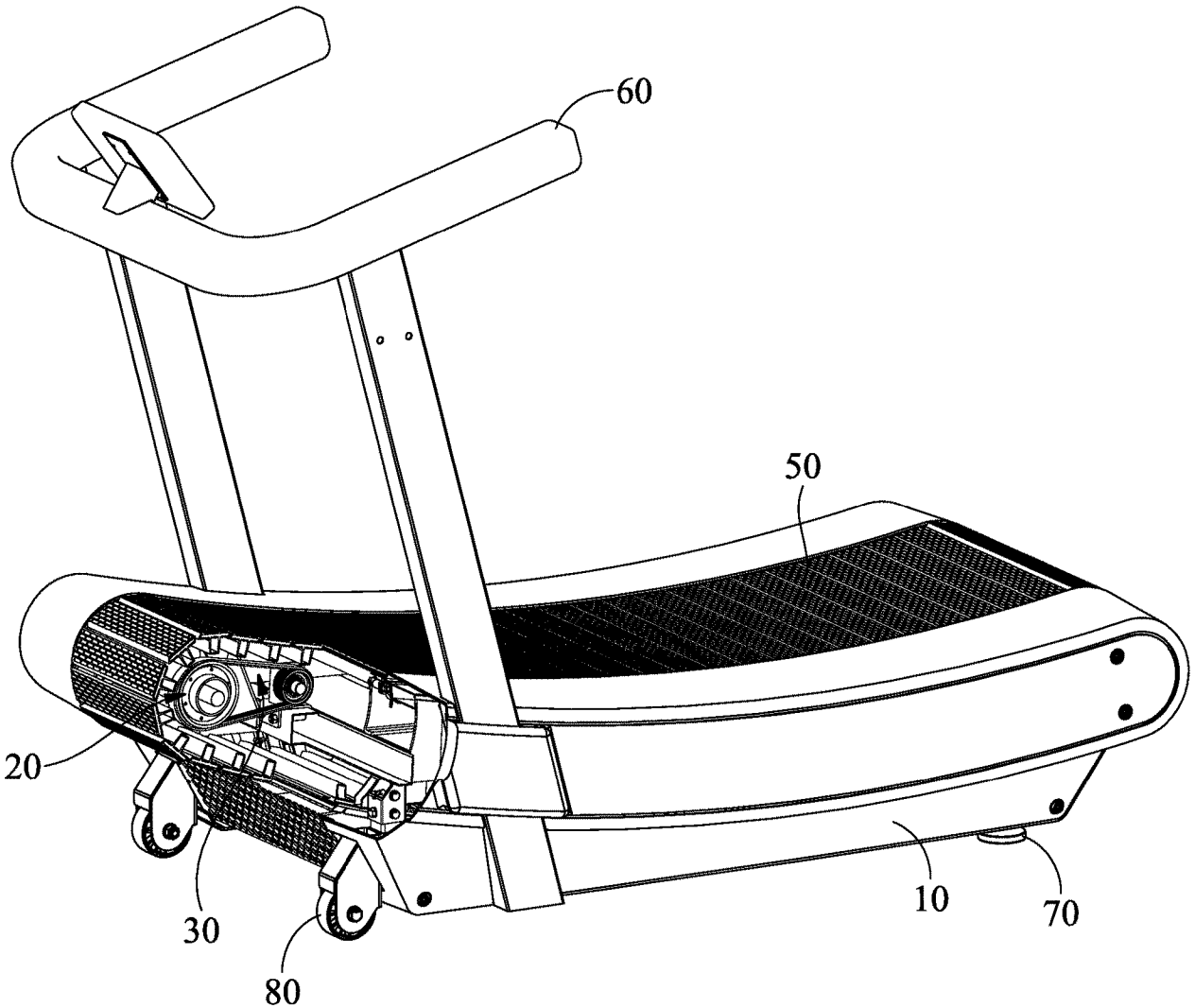
FIG. 1 is a partial perspective view of the treadmill in the present invention showing an overview and a restraint device in the treadmill of the present invention.

Please refer to FIG. 1, which is a partial perspective view of the treadmill 1 in the present invention, showing the overview and the restraint device 30 in the treadmill 1 of the present invention. As shown in the figure, the treadmill 1 of the present invention is a slat-belt treadmill, and a running belt 50 is driven manually without a motor. In general, the treadmill 1 of the present invention includes a frame 10, the restraint device 30 and the running belt 50. The frame 10 has a front support portion 20 and a rear support portion 40 (not shown in FIG. 1), and the running belt 50 surrounds and is supported on the front support portion 20 and the rear support portion 40. When a user is running on the treadmill 1, the force generated by the user moves the running belt 50 and causes the front support portion 20 and the rear support portion 40 to rotate. The restraint device 30 is a safety device in the treadmill 1, which allows the running belt 50 to rotate in a first rotating direction (such as a clockwise direction), and provides a restraint force to the front support portion 20 when the running belt 50 is to rotate in a second rotating direction (such as a counterclockwise direction), to restrain a rotation of the running belt 50 in the second rotating direction.

Figure 2:
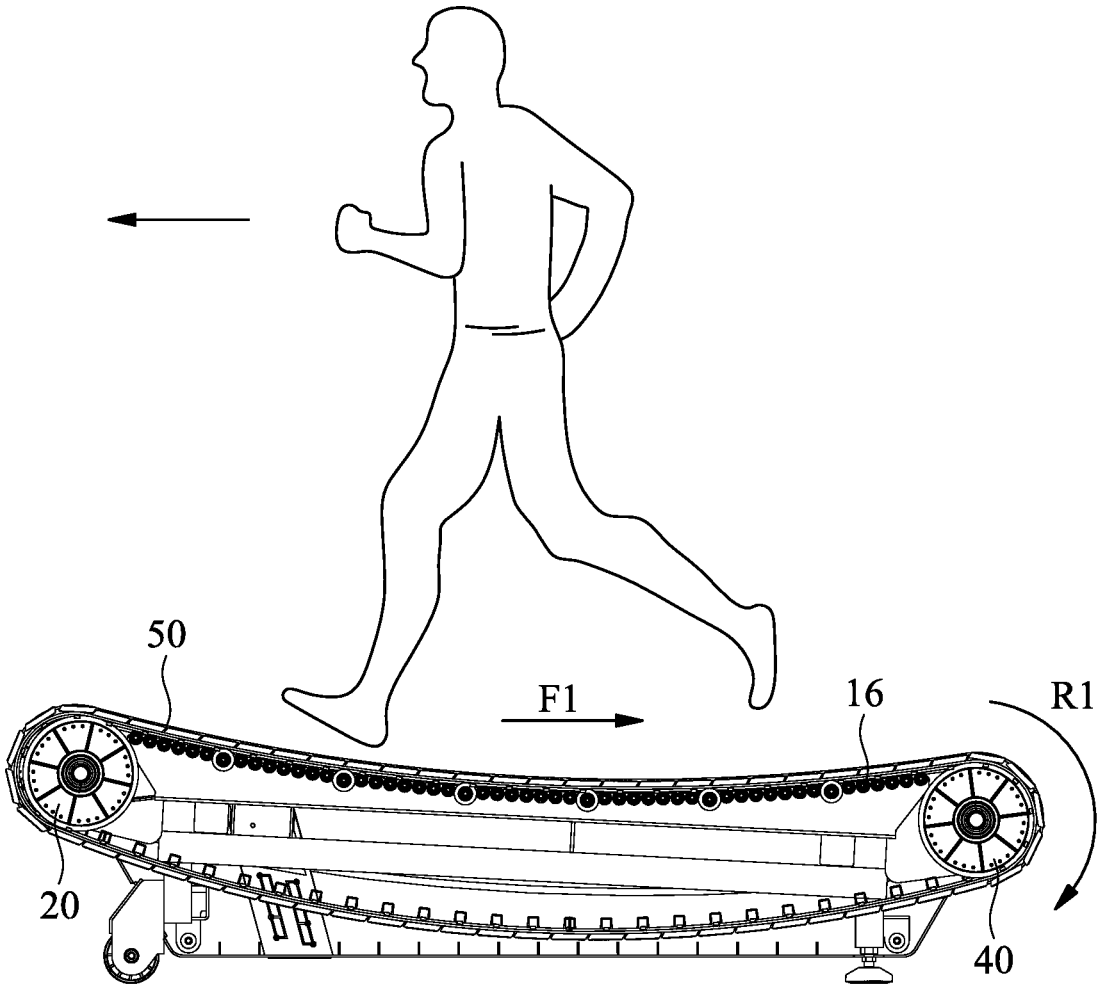
FIG. 2 is a diagram of the treadmill of the present invention that rotates in the first rotating direction.
Figure 3:
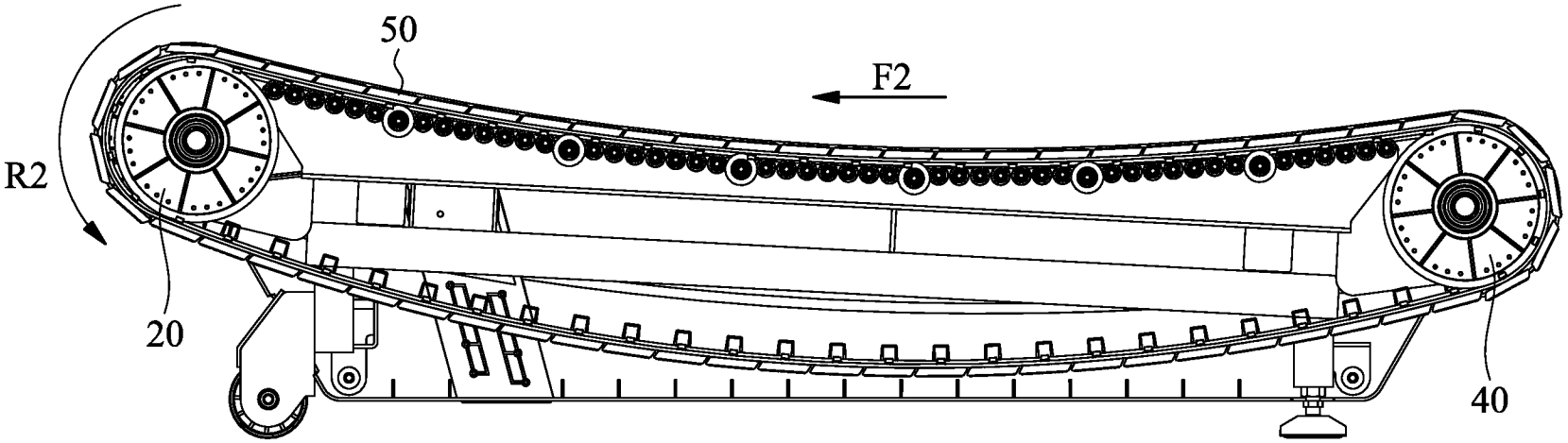
FIG. 3 is a diagram of the treadmill of the present invention that rotates in the second rotating direction.

Please refer to FIGS. 2 and 3, which are diagrams of the treadmill 1 of the present invention rotating in the first rotating direction and the second rotating direction, respectively. In FIG. 2, the user moves from the rear support portion 40 toward the front support portion 20 to generate a backward force F1 on the running belt 50 of the treadmill 1, causing the running belt 50 to rotate in the first rotating direction R1. It can be seen from FIGS. 2 and 3 that the running belt 50 of the treadmill 1 of the present invention has a curved upper surface for the directional movement of the user, and has a curved lower surface with respect to the curved upper surface. When the user stands at the rear end of the treadmill 1, since the running belt 50 has a curvature, the user's weight will generate a forward force F2 on the running belt 50, causing the running belt 50 to rotate in the second rotating direction R2 (as shown in FIG. 3). When the running belt 50 rotates in the second rotating direction R2, the restraint device 30 in the treadmill 1 of the present invention will provide a restraint force to increase the resistance experienced by the running belt 50 on the second rotating direction R2, and thereby slowing the speed that the running belt 50 rotates in the second rotating direction R2 or stopping the running belt 50 from rotating in the second rotating direction R2. Due to the restraint force provided by the restraint device 30, the user exercising (either running or walking) on the running belt 50 may easily find that the resistance on the second rotating direction R2 is greater than that on the first rotating direction R1. Thus, the user can take advantage of the difference of the resistances in the opposite directions so as to keep his or her body's balance. This design prevents the user from losing his or her balance on the treadmill with a curved surface.

Please refer to FIG. 1, the treadmill 1 of the present invention optionally includes handrails 60 to increase the safety of the user on the treadmill. According to the present invention, the handrails 60 are removable. The treadmill 1 of the present invention further includes a plurality of supporting feet 70 and a plurality of supporting wheels 80, which are in contact with the ground when the treadmill 1 is in operation, thereby increasing the stability of the treadmill 1. When the user wants to move the treadmill 1 to another position, the treadmill 1 can also be easily moved using the plurality of supporting wheels 80. In one embodiment, the front end and the rear end of the treadmill 1 are provided with a pair of supporting wheels 80 and a pair of supporting feet 70, respectively. In other embodiments, the positions of the pair of supporting wheels 80 and the pair of supporting feet 70 are interchangeable. In addition, in other embodiments, the numbers of the supporting feet 70 and the supporting wheels 80 may be more than two.

Figure 4:
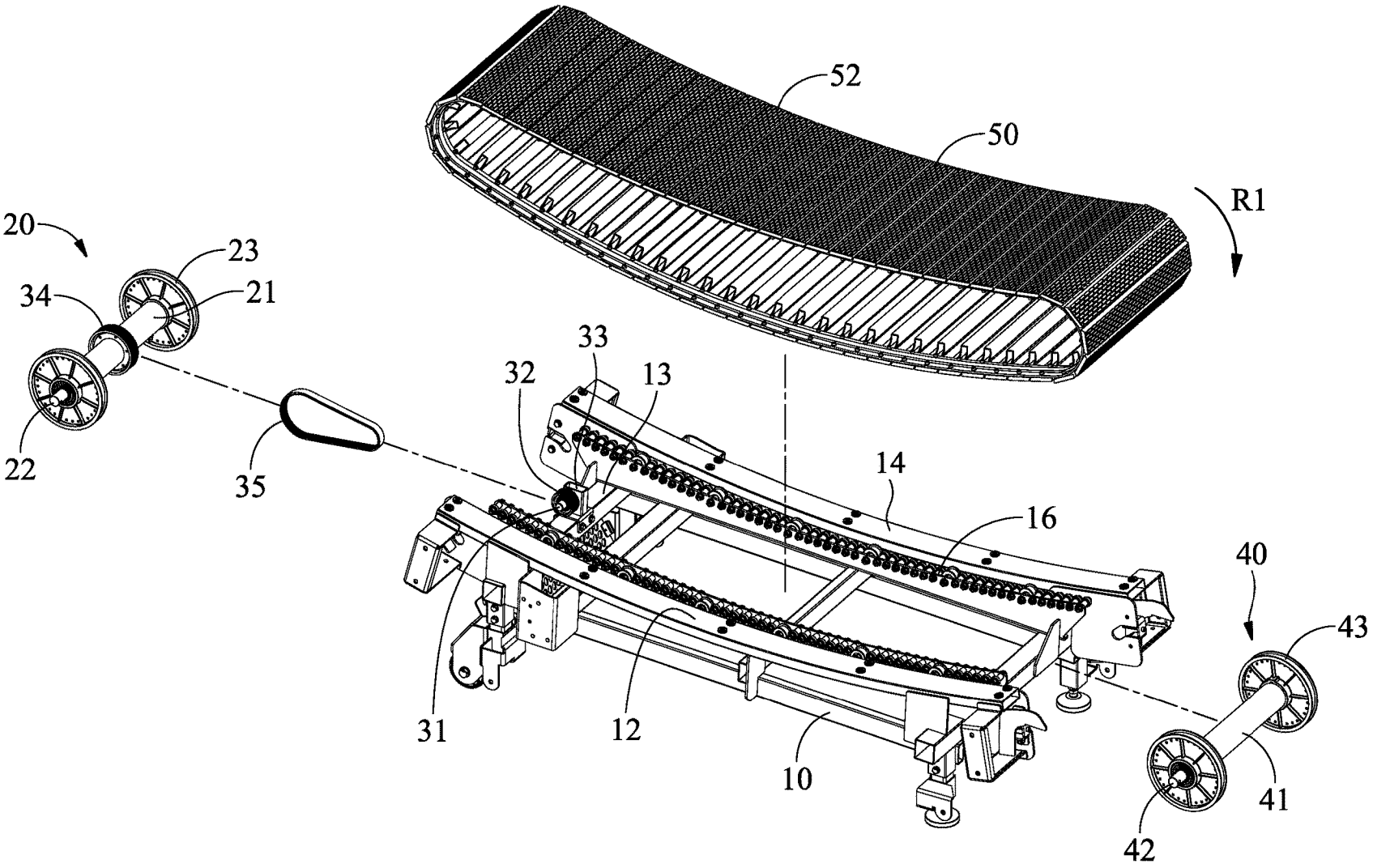
FIG. 4 is an exploded view of the treadmill of the present invention showing the running belt and the interior components thereof.

Please refer to FIG. 4, which is an exploded view of the treadmill 1 in the present invention showing the running belt 50 and internal components of the treadmill 1 of the present invention. The frame 10 has a left peripheral side 12, a right peripheral side 14 and a plurality of cross beams 13 between the left peripheral side 12 and the right peripheral side 14 for stabilizing the structure of the frame 10. The running belt 50 is composed of a plurality of parallel slats 52, and each slat is disposed across the left peripheral side 12 and the right peripheral side 14. A row of bearings 16 (preferably ball bearings) is provided on each of the left peripheral side 12 and the right peripheral side 14 to support the lateral edges of the running belt 50 and maintain the curved upper surface of the running belt 50, while the lower surface of the running belt 50 droops down due to gravity. Referring to FIGS. 2 to 4, it can be found that the running belt 50 is supported on the front support portion 20, the rear support portion 40 and two rows of bearings 16 on both sides.

Other elements of the treadmill 1 of the present invention are described as follows. The front support portion 20 is provided at the front end and the rear support portion 40 is provided at the rear end of the frame 10, wherein the front support portion 20 includes a front sleeve 21, a front shaft 22 and a pair of front pulleys 23, and the rear support portion 40 includes a rear sleeve 41, a rear shaft 42 and a pair of rear pulleys 43. Two ends of the front shaft 22 and two ends of the rear shaft 42 are fixed to the front end and the rear end of the frame 10, respectively, so that the front support portion 20 and the rear support portion 40 are coupled to the front end and the rear end of the frame 10, respectively. In addition, the positions where the front shaft 22 and the rear shaft 42 fix to the frame 10 are adjustable. The tension of the running belt 50 can be controlled by adjusting the distance between the front shaft 22 and the rear shaft 42.

The front sleeve 21 is coupled to the front shaft 22 and rotates relative to the fixed front shaft 22. The front pulleys 23 are arranged at both ends of the front sleeve 21 to support the running belt 50 and rotate with the running belt 50. The rear sleeve 41 is coupled to the rear shaft 42 and rotates relative to the fixed rear shaft 42. The rear pulleys 43 are arranged at both ends of the rear sleeve 41 to support the running belt 50 and rotate with the running belt 50. When the user moves on the treadmill 1 and causes the running belt 50 to rotate, the running belt 50 causes the front sleeve 21, the front pulleys 23, the rear sleeve 41 and the rear pulleys 43 to rotate. Since the front pulleys 23 and the rear pulleys 43 of the treadmill 1 of the present invention are respectively arranged at the two ends of the front sleeve 21 and the two ends of the rear sleeve 41, when the front pulleys 23 and the rear pulleys 43 rotate, the front sleeve 21 bears the torque caused by the rotation of the front pulleys 23 and the rear sleeve 41 bears the torque caused by the rotation of the rear pulleys 43. On the other hand, the front shaft 22 and the rear shaft 42 are configured to be fixed to the frame 10, so the front shaft 22 and the rear shaft 42 bear the weights of the front support portion 20 and the rear support portion 40, respectively, but do not need to bear the torques due to the rotations of the front pulleys 23 and the rear pulleys 43, which avoids the disadvantage of excessive wear of the front shaft 22 and the rear shaft 42 and makes the treadmill 1 more reliable and durable.

FIG. 4 also shows the elements of the restraint device 30, wherein the restraint device 30 includes a one-way bearing 32, a rotating element 34 and a transmission element 35. The one-way bearing 32 is fixed to the frame 10, especially to the cross beam 13, via a shaft 31 and a shaft housing 33. The shaft 31 is supported on the shaft housing 33 in a direction substantially parallel to the cross beam 13, the front shaft 22 and the rear shaft 42. The one-way bearing 32 surrounds the shaft 31 and can only rotate in the first rotating direction R1. In one embodiment, the rotating element 34 is disposed on the front support portion 20, preferably coupled to the front sleeve 21. In another embodiment, the rotating element 34 is disposed on the rear support portion 40, preferably coupled to the rear sleeve 41. Preferably, the rotating element 34 is coupled to a middle position of the front sleeve 21 and can rotate with the running belt 50. The transmission element 35 surrounds and connects the one-way bearing 32 and the rotating element 34, such that the rotating direction that the one-way bearing 32 and the rotating element 34 rotate is substantially parallel to the rotating direction that the front support portion 20 and the rear support portion 40 rotate. In another embodiment, the treadmill of the present invention can include two restraint devices disposed on the front support portion and the rear support portion.

The rotating element 34 can be made of various materials, including but not limited to plastic, metal, rubber, wood, and the like. Those skilled in the art should understand that the rotating element 34 can be fixed to the front sleeve 21 in different ways. In one embodiment, the rotating element 34 is fixed to a flange on the front sleeve 21 via bolts, and the flange is welded to the front sleeve 21. In other embodiments, the rotating element 34 can be directly welded to the front sleeve 21, affixed to the front sleeve 21 using an adhesive, attached to the flange of the front sleeve 21 using rivets, or fixed to the front sleeve 21 by any other method known in the art. It should be appreciated for those skilled in the art that the fixing method between the rotating element 34 and the front sleeve 21 (or the rear sleeve 41) can be changed according to the type of the rotating element 34. The actuation of the restraint device 30 in the present invention will be described in details below.

Figure 5:
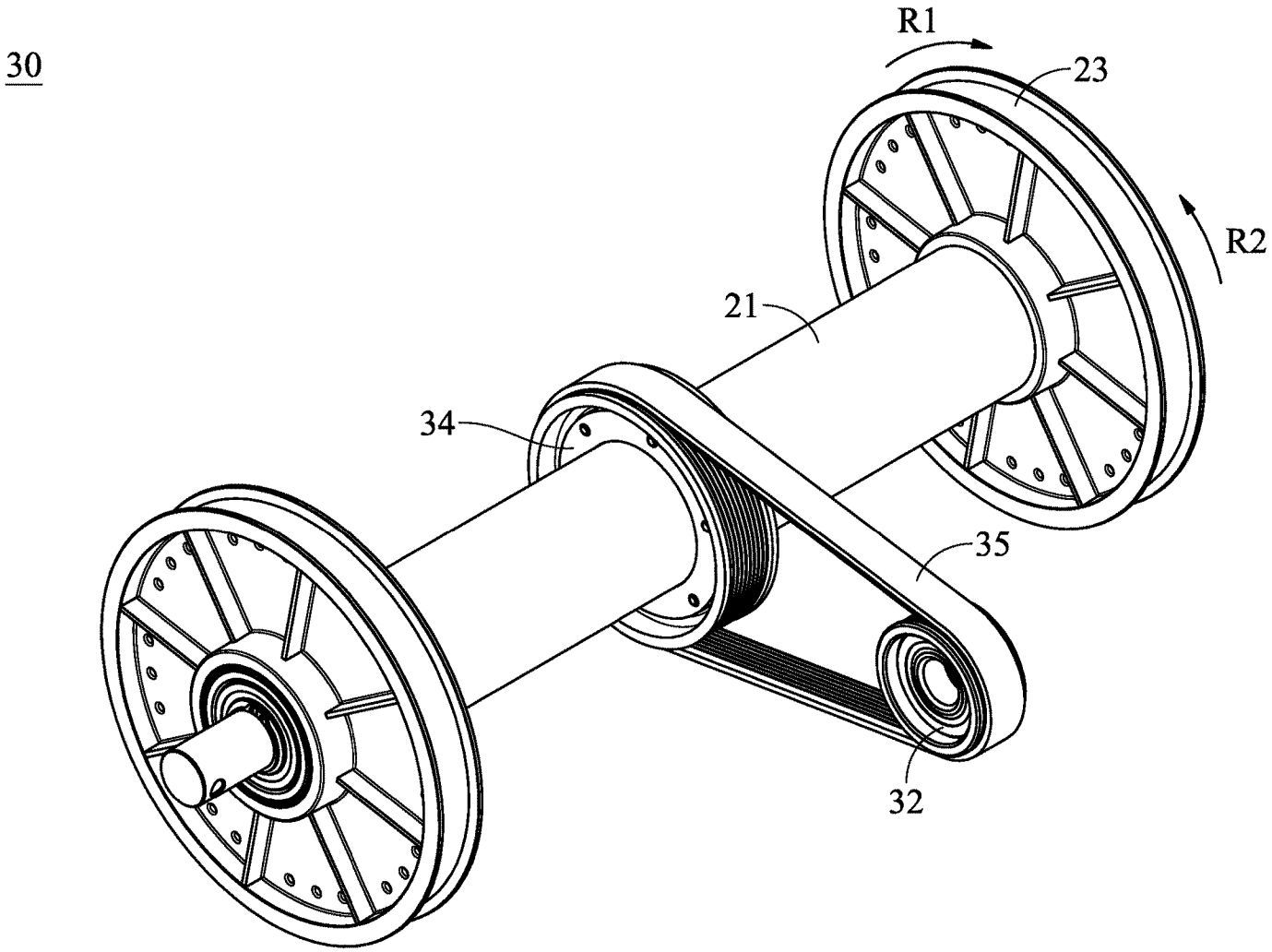
FIG. 5 is a diagram of the restraint device according to the first embodiment of the present invention.

Please refer to FIG. 5, which is a diagram of the restraint device 30 according to the first embodiment of the present invention. As an example, the rotating element 34 of the restraint device 30 in FIG. 5 is arranged on the front sleeve 21 to provide a restraint force to the front sleeve 21. However, the rotating element 34 can also be arranged on the rear sleeve 41 to provide the restraint force to the rear sleeve 41. The one-way bearing 32 and the rotating element 34 are connected by the transmission element 35, and the transmission element 35 is frictionally engaged with the rotating element 34 and the one-way bearing 32. When the front sleeve 21 rotates in the first rotating direction R1, both of the rotating element 34 and the one-way bearing 32 rotate in the first rotating direction R1. Because the one-way bearing 32 cannot rotate in the second rotating direction R2, when the front sleeve 21 is to rotate in the second rotating direction R2, the transmission element 35 causes the rotating element 34 to encounter a specific restraint force in the second rotating direction R2, or causes the rotating element 34 not to rotate in the second rotating direction R2.

In various examples, the restraint device 30 of the present invention may be implemented in different ways. As shown in FIG. 5, the rotating element 34 in the restraint device 30 in the present invention may be a pulley, and the transmission element 35 may be a belt. A kinetic friction force is generated due to a relative sliding between the transmission element 35 and the rotating element 34 and between the transmission element 35 and the one-way bearing 32 when the one-way bearing 32 stops and the rotating element 34 is to rotate with the running belt 50 in the second rotating direction R2, to restrain a rotation of the running belt 50 and the rotating element 34 in the second rotating direction R2. Affected by this restraint force, the speed of the front pulleys 23 and the rear pulleys 43 in the second rotating direction R2 will be limited, and thus the speed of the running belt 50 in the second rotating direction R2 will also be limited.

Figure 6:
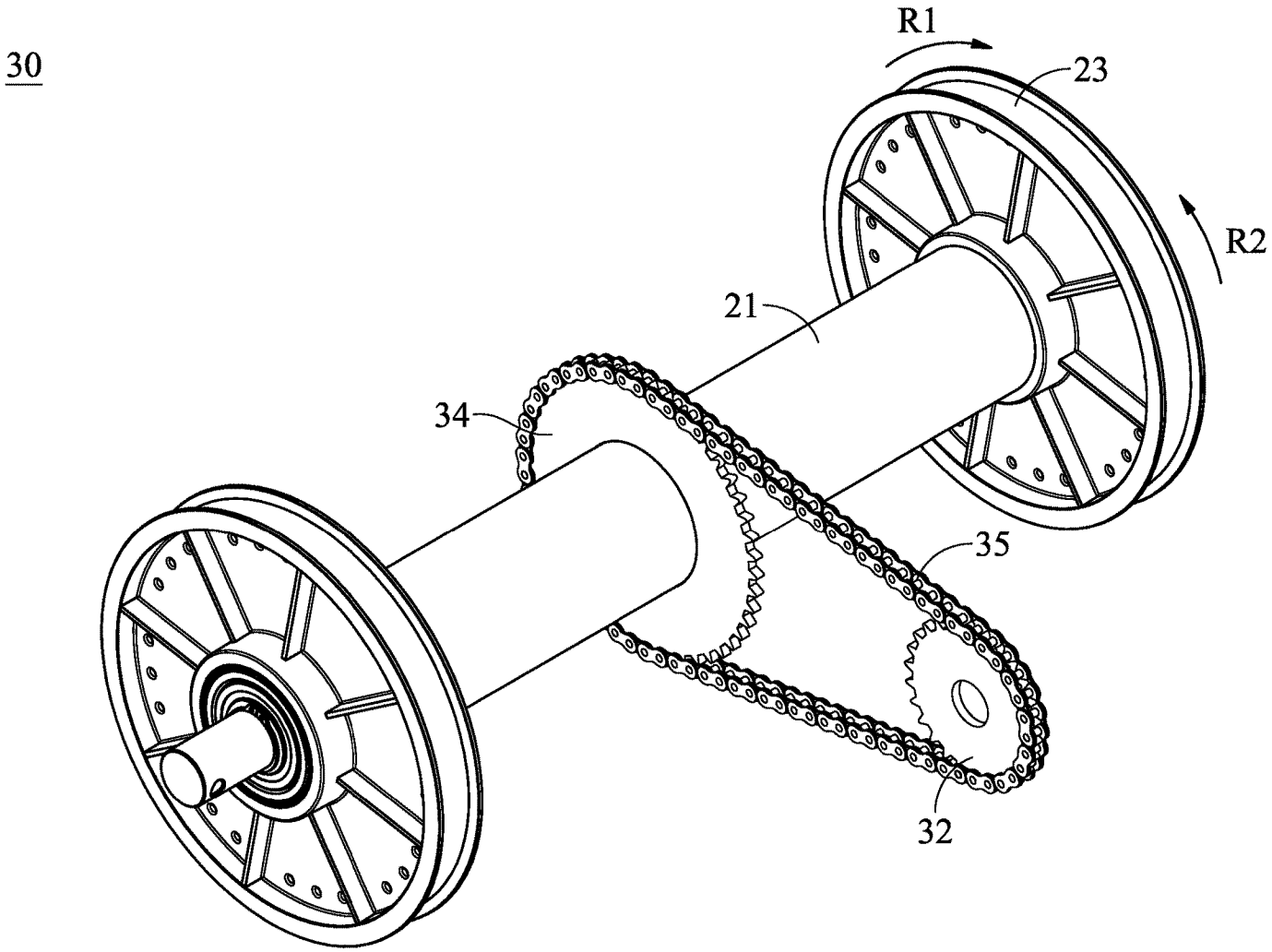
FIG. 6 is a diagram of the restraint device according to the second embodiment of the present invention.
Figure 7:
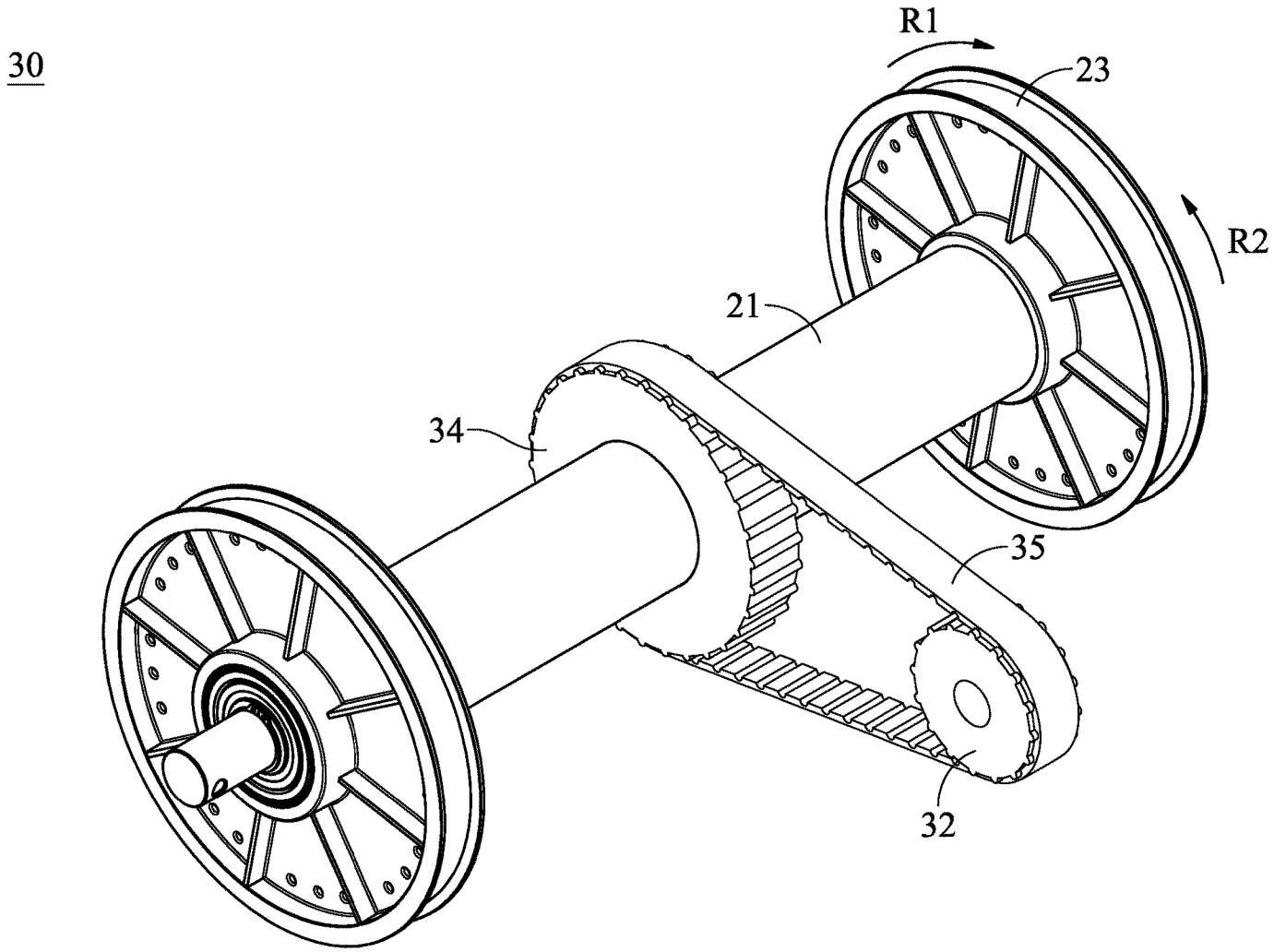
FIG. 7 is a diagram of the restraint device according to the third embodiment of the present invention.

Please refer to FIGS. 6 and 7, which are diagrams of the restraint devices 30 according to the second embodiment and the third embodiment of the present invention, respectively. As shown in FIG. 6, the rotating element 34 can be a gear, the one-way bearing 32 also has a gear structure around the periphery thereof, and the transmission element 35 can be a chain. As shown in FIG. 7, the rotating element 34 may be a belt pulley, the one-way bearing 32 also has a structure of the belt pulley around the periphery thereof, and the transmission element 35 may be a cogged-belt. In these two embodiments, the structures of the gear and the chain are engaged with each other, and the structures of the belt pulley and the cogged-belt are engaged with each other. A static friction force is generated between the transmission element 35 and the rotating element 34 and between the transmission element 35 and the one-way bearing 32 because the one-way bearing 32 stops when the running belt 50 is pushed toward the second rotating direction R2 by the user, such that the running belt 50 and the rotating element 34 cannot freely rotate in the second rotating direction R2.

The friction resistance of the treadmill 1 of the present invention is determined by the tension setting of the transmission element 35 in the restraint device 30 and the tension of the running belt 50. The set tension of the transmission element 35 and the running belt 50 as well as their respective internal friction allow the running belt 50 of the treadmill 1 in the present invention to freely rotate in one direction, but are speed limited in the reverse direction. Accordingly, in some embodiments of the present disclosures, the restraint device 30 is also referred to as a speed-limiting device.

With the restraint device of the present invention, the user can only move in one direction or move in both directions on the treadmill. In the case of moving in both directions, the running belt can freely rotate in the first rotating direction and slowly rotate in the second rotating direction. In the case of movement in only one direction, the running belt cannot rotate in the second rotating direction. The configuration of the restraint device prevents the user from losing his balance on the treadmill due to forward sliding, which has advantage over the prior art.

Figure 8:
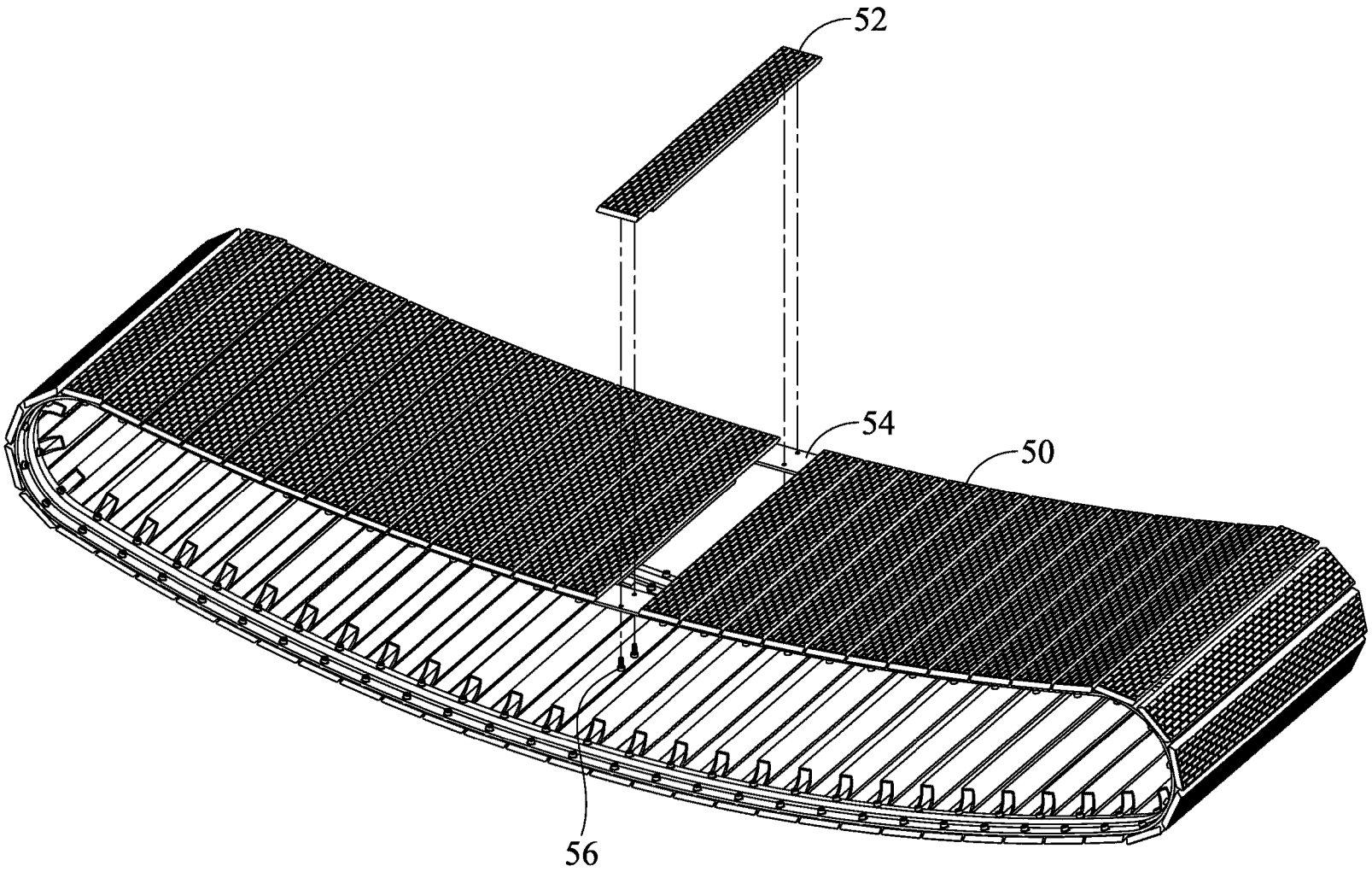
FIG. 8 is a perspective view of the running belt of the treadmill in the present invention showing that the miming belt includes a plurality of slats.

Another aspect of the present application is to provide a slat structure suitable for a slat-belt treadmill, and this slat-belt treadmill can be a manual treadmill or an electric treadmill. As for the structural relationship between the running belt and the slats in the present application, please refer to FIG. 8, which is a perspective view of the running belt of the treadmill in the present invention, showing that the running belt 50 is composed of a plurality of slats 52. The plurality of slats 52 are attached in parallel one by one and adjacent to one another to form the running belt 50 for the user to move thereon. In particular, the two ends of each slat 52 are fixed on the two transmission belts 54 by fixing elements 56, and each transmission belt 54 is supported on the bearing 16 and surrounds the front pulley 23 and the rear pulley 43 (as shown in FIG. 2). When the front pulley 23 and the rear pulley 43 rotate, the transmission belt 54 and the running belt 50 are driven to rotate.

Figure 9:
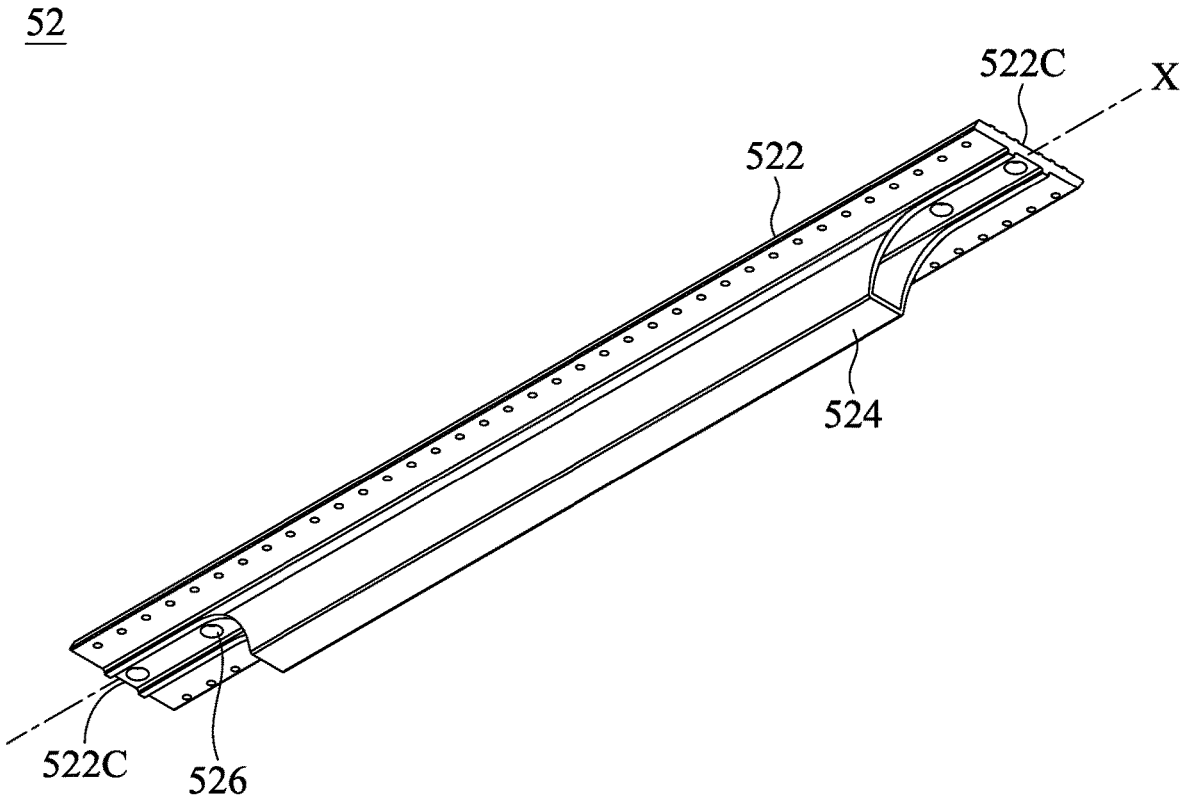
FIG. 9 is a perspective view of an individual slat according to the fourth embodiment of the present invention.
Figure 10:
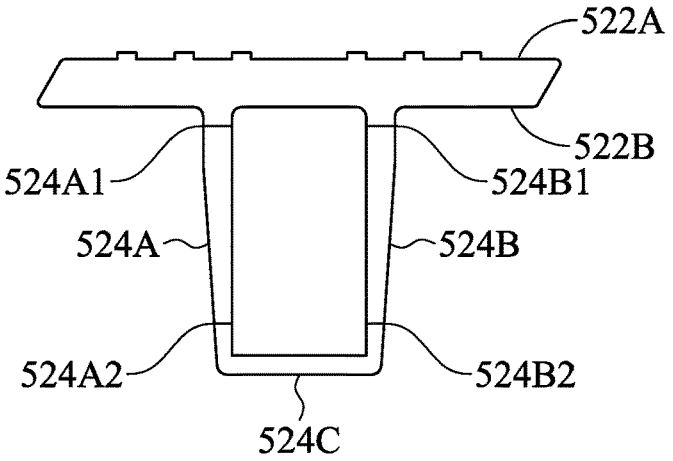
FIG. 10 is a side view of the slat according to FIG. 9.
Figure 11:
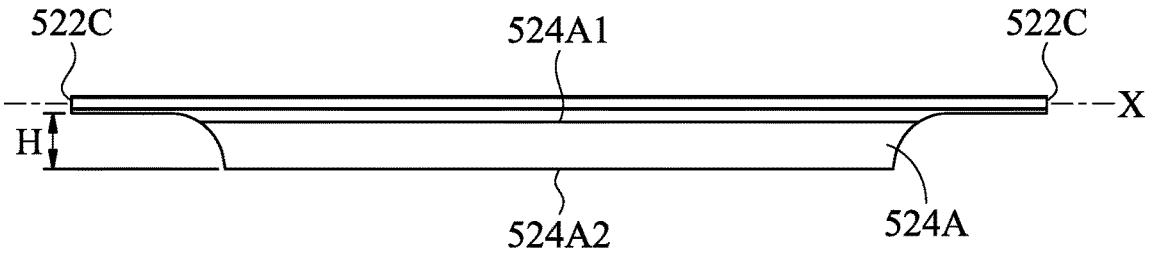
FIG. 11 is a front view of the slat according to FIG. 9.
Figure 12A:
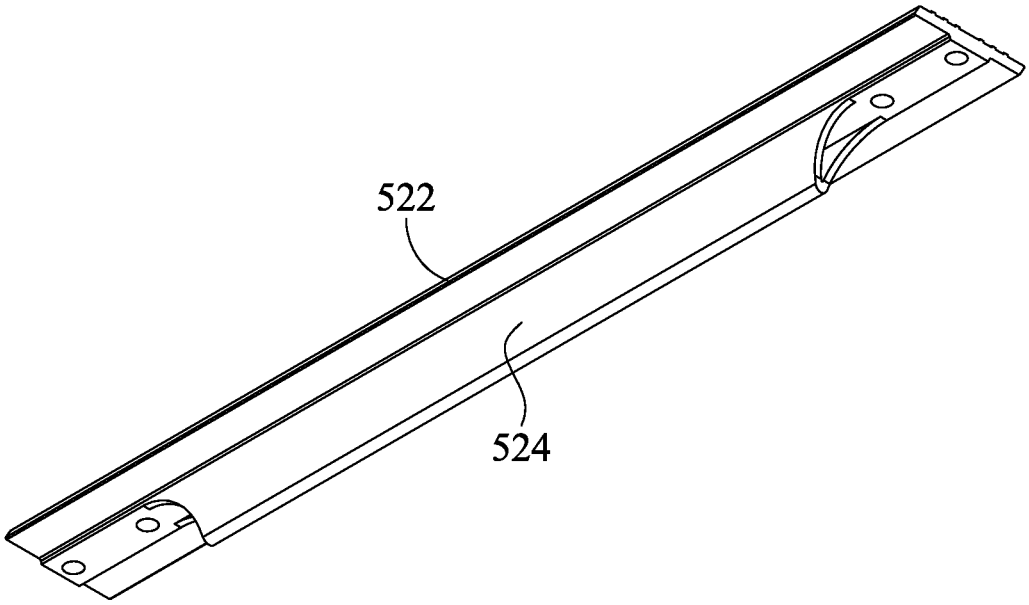
FIG. 12A is a perspective view of an individual slat according to the fifth embodiment of the present invention.
Figure 12B:
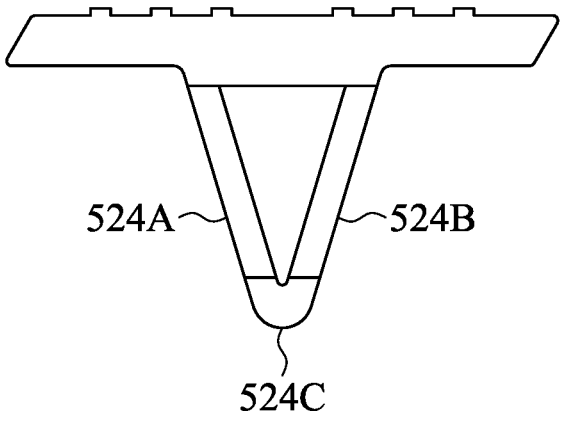
FIG. 12B is a side view of the slat according to FIG. 12A.
Figure 13A:
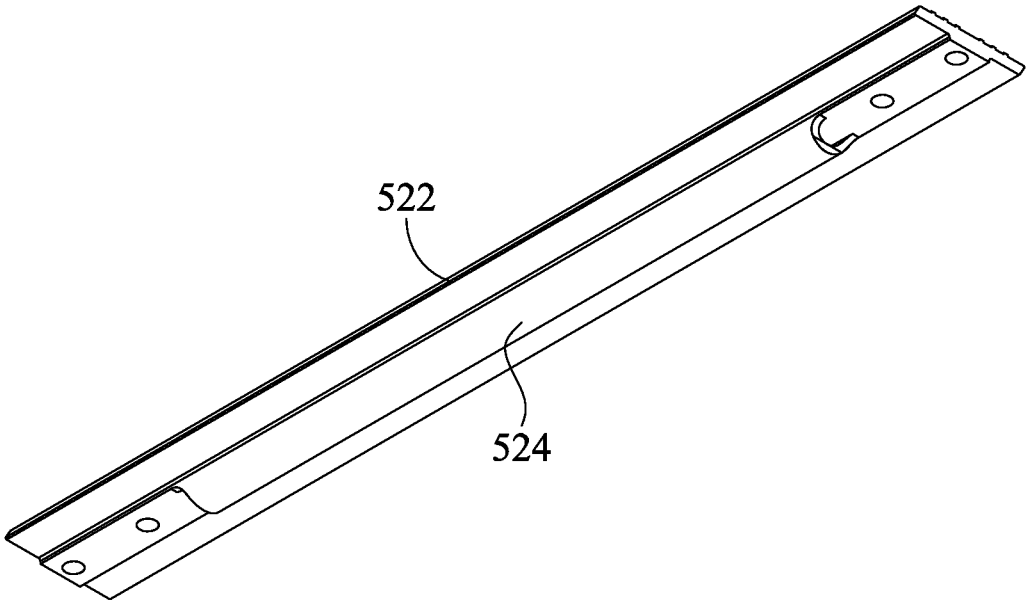
FIG. 13A is a perspective view of an individual slat according to the sixth embodiment of the present invention.
Figure 13B:
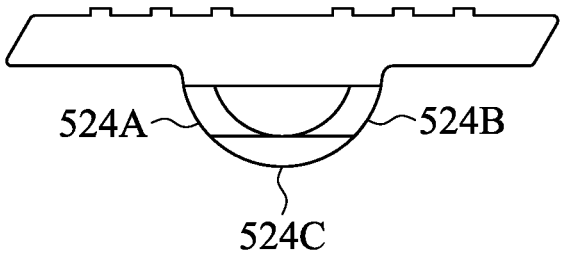
FIG. 13B is a side view of the slat according to FIG. 13A.
Figure 14A:
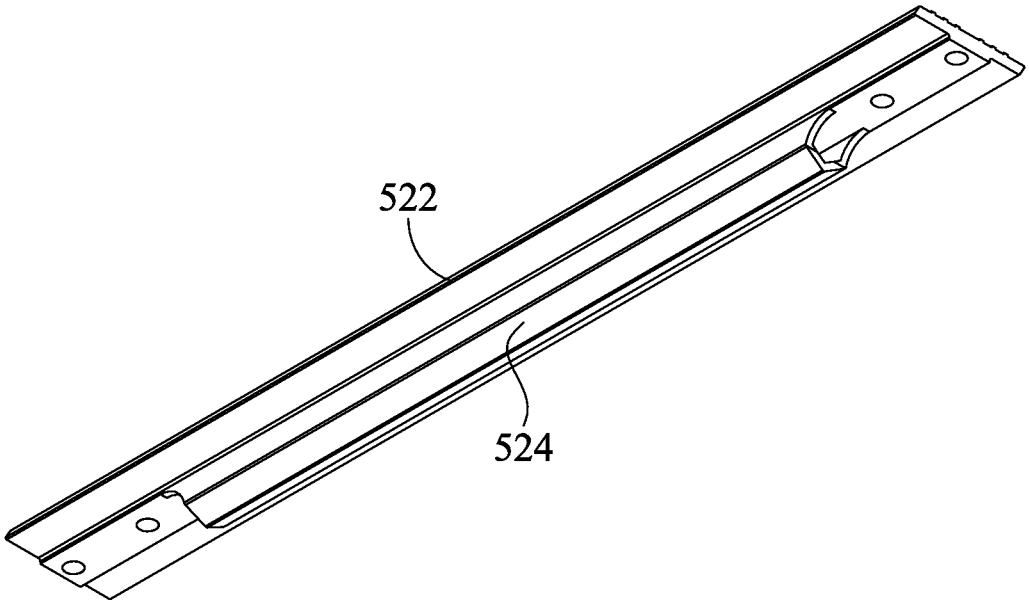
FIG. 14A is a perspective view of an individual slat according to the seventh embodiment of the present invention.
Figure 14B:
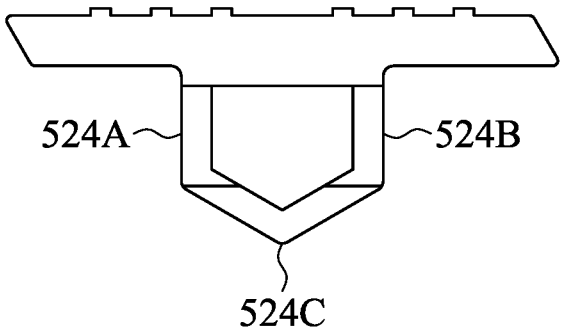
FIG. 14B is a side view of the slat according to FIG. 14A.
Figure 15A:
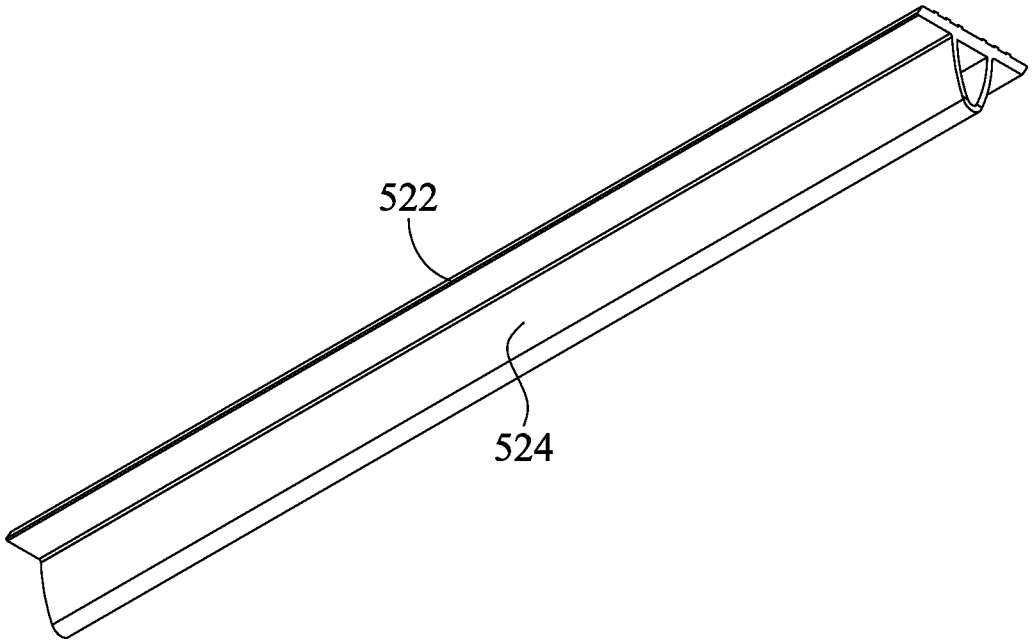
FIG. 15A is a perspective view of an individual slat according to the eighth embodiment of the present invention.
Figure 15B:
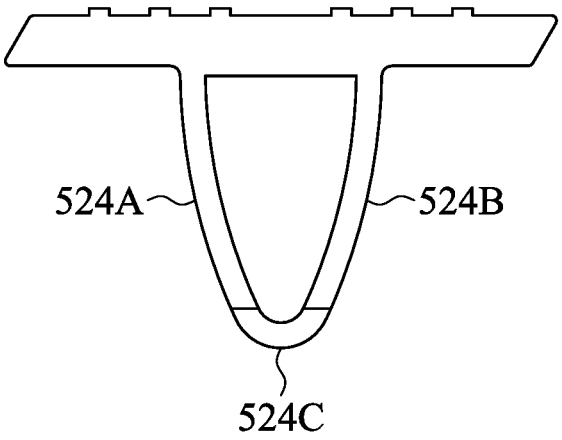
FIG. 15B is a side view of the slat according to FIG. 15A.
Figure 16A:
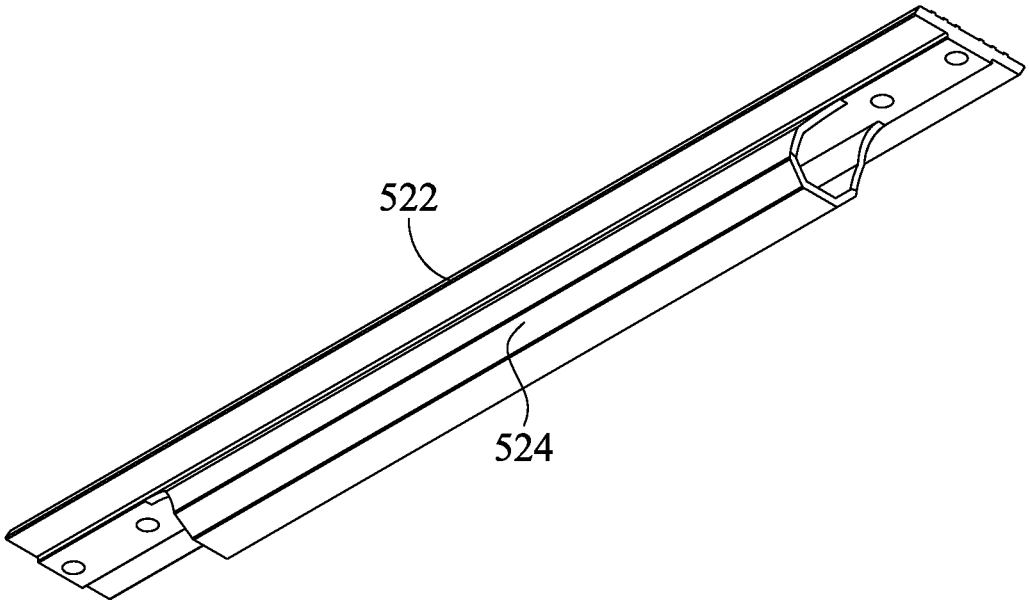
FIG. 16A is a perspective view of an individual slat according to the ninth embodiment of the present invention.
Figure 16B:
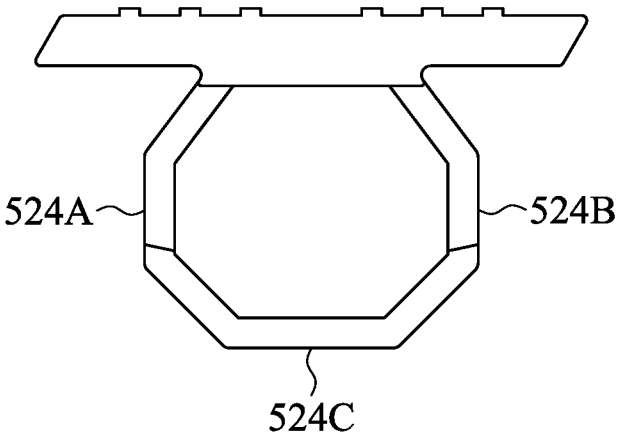
FIG. 16B is a side view of the slat according to FIG. 16A.
Figure 17A:
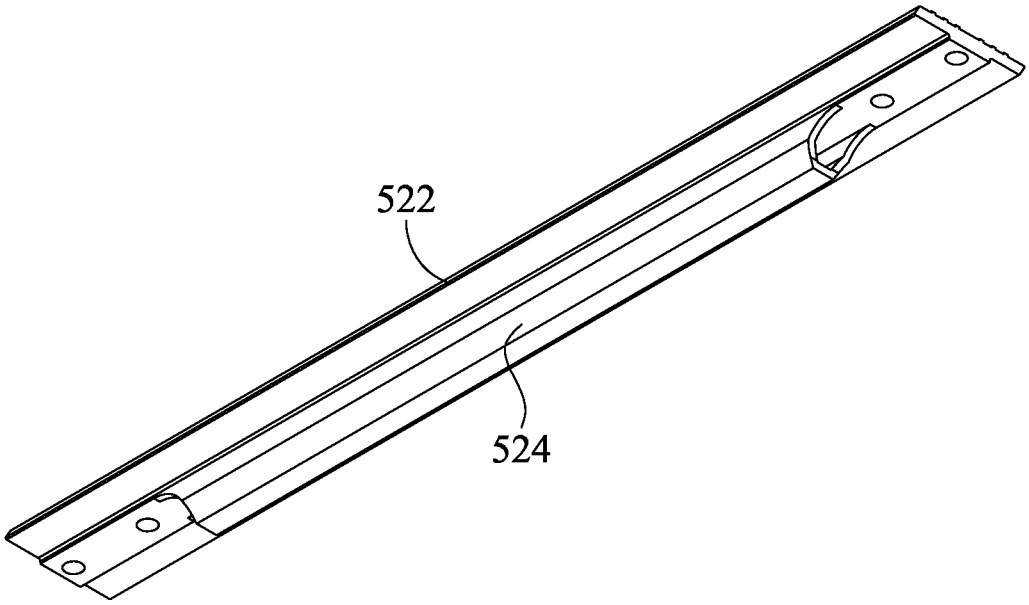
FIG. 17A is a perspective view of an individual slat according to the tenth embodiment of the present invention.
Figure 17B:
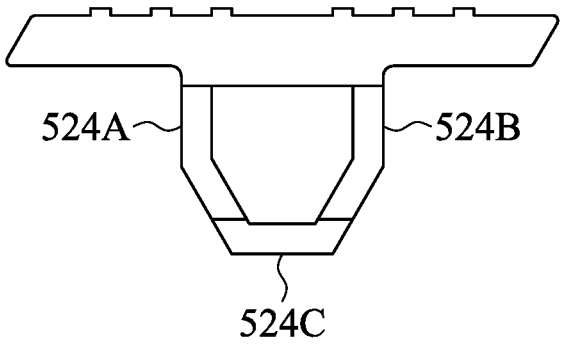
FIG. 17B is a side view of the slat according to FIG. 17A.

FIGS. 9 to 11 are a perspective view, a side view and a front view of an individual slat 52 according to a fourth embodiment of the present invention, respectively. The slat 52 includes a body 522 and a hollow beam 524. The body 522 and the hollow beam 524 jointly bear a force from a user. The body 522 is a long strip with an upper surface 522A, a lower surface 522B and two opposite ends 522C, wherein the body 522 extends along a longitudinal direction X (as shown in FIGS. 9 and 11). The body 522 further has fixing holes 526 through which the fixing elements 56 can pass. In order to reduce the impact on the user's feet when he moves on the running belt, the upper surface 522A of the body 522 can also be covered with a layer of cushioning material, such as rubber (not shown).

As shown in FIGS. 9 and 10, the hollow beam 524 protrudes downward from the body 522, wherein the hollow beam 524 includes a first strengthening piece 524A, a second strengthening piece 524B and a bottom piece 524C. The first strengthening piece 524A is disposed on the lower surface 522B of the body 522 substantially along the longitudinal direction X, and has a first longitudinal side 524A1 connected to the lower surface 522B and an opposite second longitudinal side 524A2. The second strengthening piece 524B is disposed in parallel to the first strengthening piece 524A on the lower surface 522B, and has a first longitudinal side 524B1 connected to the lower surface 522B and an opposite second longitudinal side 524B2 (as shown in FIG. 10). The bottom piece 524C connects the second longitudinal side 524A2 of the first strengthening piece 524A and the second longitudinal side 524B2 of the second strengthening piece 524B, to disperse stresses generated by the force on the body 522, the first strengthening piece 524A, the second strengthening piece 524B and the bottom piece 524C along the longitudinal direction X.

FIG. 11 is a front view of the slat according to FIG. 9, in which only the first strengthening piece 524A is shown. As shown in FIG. 11, the first strengthening piece 524A has a constant horizontal height H along the longitudinal direction X, and the second strengthening piece 524B is the same. In order to make the two ends 522C of the slat 52 across the bearings 16 on the left and right sides, the horizontal height H gradually decreases when the first strengthening piece 524A and the second strengthening piece 524B extend along the longitudinal direction X to approach the two ends 522C. Preferably, the portions of the first strengthening piece 524A and the second strengthening piece 524B close to the two ends 522C can be removed, so that the side shapes of the first strengthening piece 524A and the second strengthening piece 524B are substantially rectangular. In other embodiments, the first strengthening piece 524A and the second strengthening piece 524B may be designed as other shapes, including but not limited to trapezoid or fan-shape.

According to a preferred embodiment of the present invention, the body 522 and the hollow beam 524 of the slat 52 are preferably made of metal, and more preferably made of metal with good ductility and light weight. Preferably, the metal is aluminum. In one embodiment, the body 522 and the hollow beam 524 are integrally formed, and the first strengthening piece 524A, the second strengthening piece 524B and the bottom piece 524C are integrally formed. The body 522 and the hollow beam 524 can be formed in an integral manner by a manufacturing method well known in the art, for example, they can be formed by the aluminum extrusion. For the hollow beam 524 formed by aluminum extrusion, the thicknesses of the first strengthening piece 524A, the second strengthening piece 524B and the bottom piece 524C are between 0.6 and 2 mm, preferably between 0.8 and 1.5 mm.

In other embodiments, the hollow beam 524 of the slat 52 in the present invention may have various modifications, please refer to FIGS. 12A to 17B. According to the side view of FIG. 10, the hollow beam 524 and the body 522 form a hollow tube, and the cross-sectional shape of the hollow tube is a rectangle. However, the cross-sectional shape is not limited to rectangle, but also includes triangle (FIGS. 12A and 12B), semicircle (FIGS. 13A and 13B), pentagon (FIGS. 14A and 14B), ellipse (FIGS. 15A and 15B), octagon (FIGS. 16A and 16B), hexagon (FIGS. 17A and 17B), square or trapezoid. In the fifth to tenth embodiments, each type of hollow beam 524 has a first strengthening piece 524A, a second strengthening piece 524B, and a bottom piece 524C.

Figure 18A:
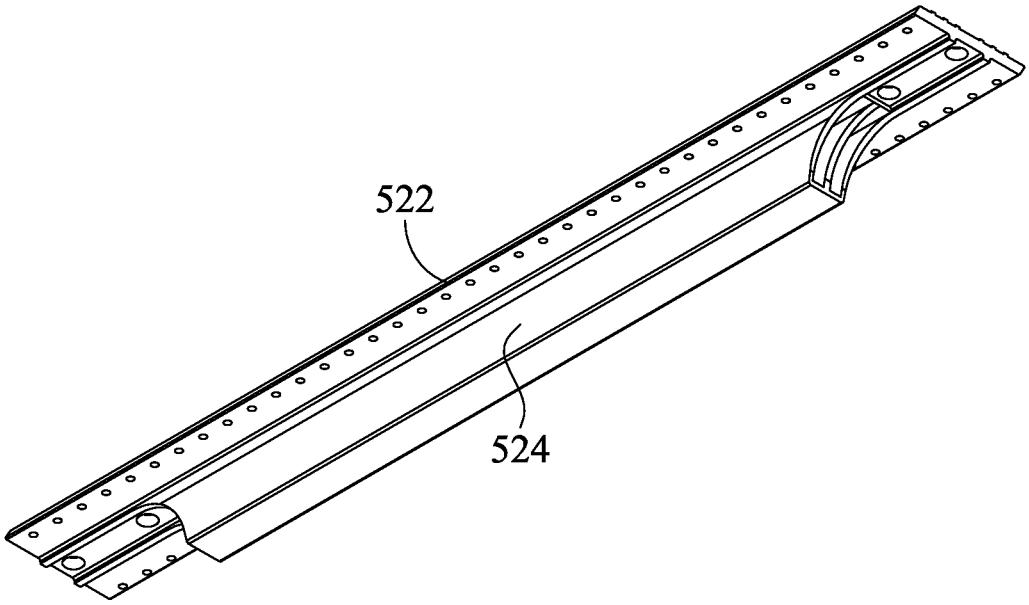
FIG. 18A is a perspective view of an individual slat according to the eleventh embodiment of the present invention.
Figure 18B:
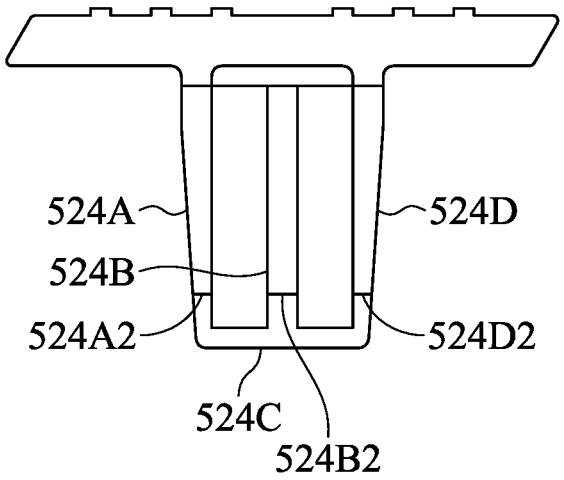
FIG. 18B is a side view of the slat according to FIG. 18A.

FIGS. 18A and 18B are a perspective view and a side view of individual slat according to the eleventh embodiment of the present invention, respectively. The number of strengthening pieces of the hollow beam 524 of the present invention may be more than two, such as three or four. In FIGS. 18A and 18B, the hollow beam 524 has a first strengthening piece 524A, a second strengthening piece 524B, a third strengthening piece 524D and a bottom piece 524C, wherein the bottom piece 524C is connected to the opposite second longitudinal sides 524A2, 524B2, 524D2 of each strengthening piece. It should be understood by the skilled person in the art that when there are more than two strengthening pieces, various materials and processes can be used to form the strengthening pieces, e.g. the materials such as metal, wood, plastic and rubber and suitable manufacturing methods can be used to form the strengthening pieces.

Figure 19A:
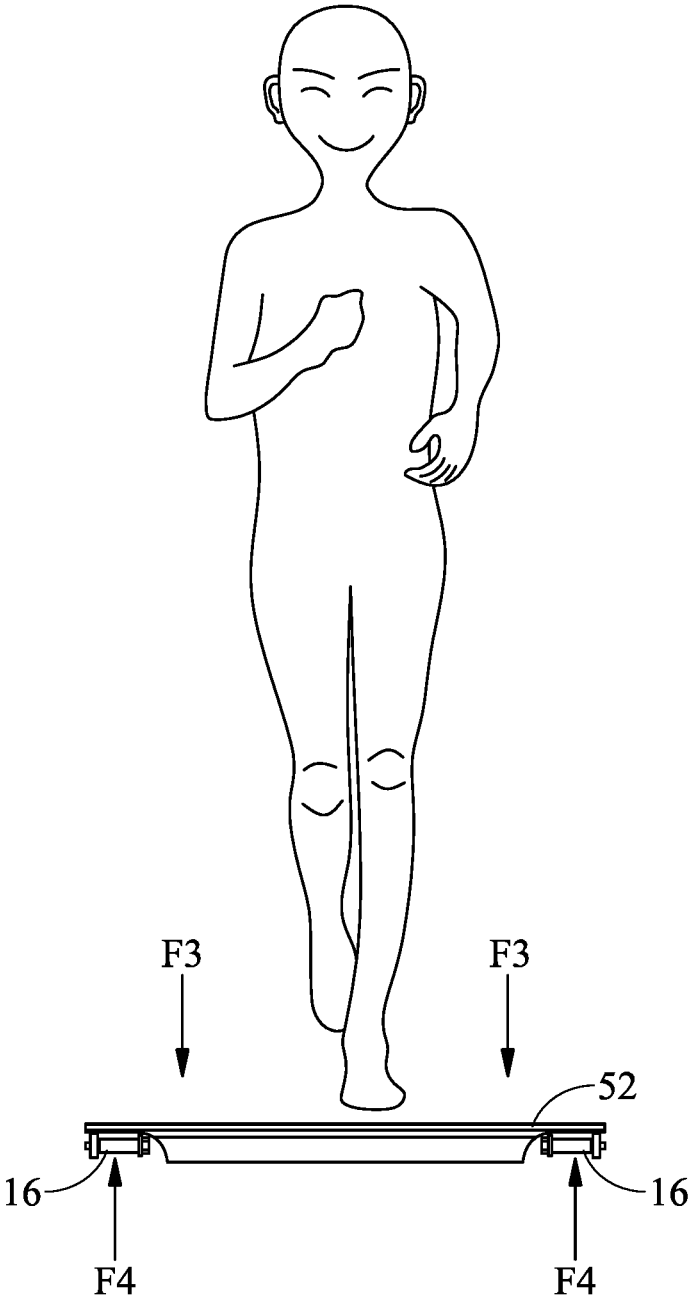
FIG. 19A is a diagram showing the force applied on the slat of the present invention.

FIG. 19A is a diagram showing the force applied on the slat 52 of the present invention. Since the running belt 50 surrounds and is supported on the front support portion 20 and the rear support portion 40, when the user is on the running belt 50 of the treadmill 1, viewed from the front of the user, the slat 52 bears a force F3 loaded by the user, and both ends of the slat 52 bear the supporting forces F4 from the bearings 16.

Figure 19B:
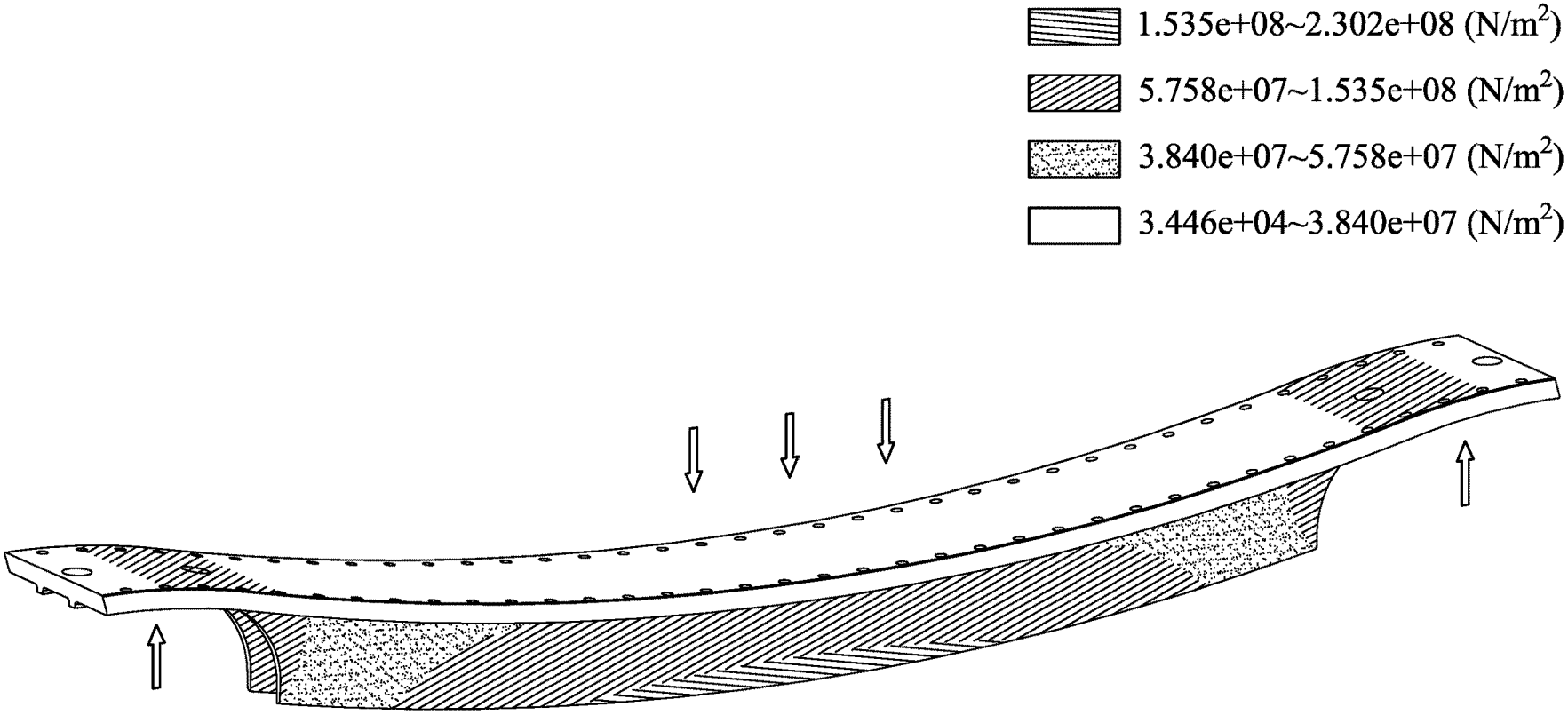
FIG. 19B is a result of the stress analysis according to the slat in the prior art.
Figure 19C:
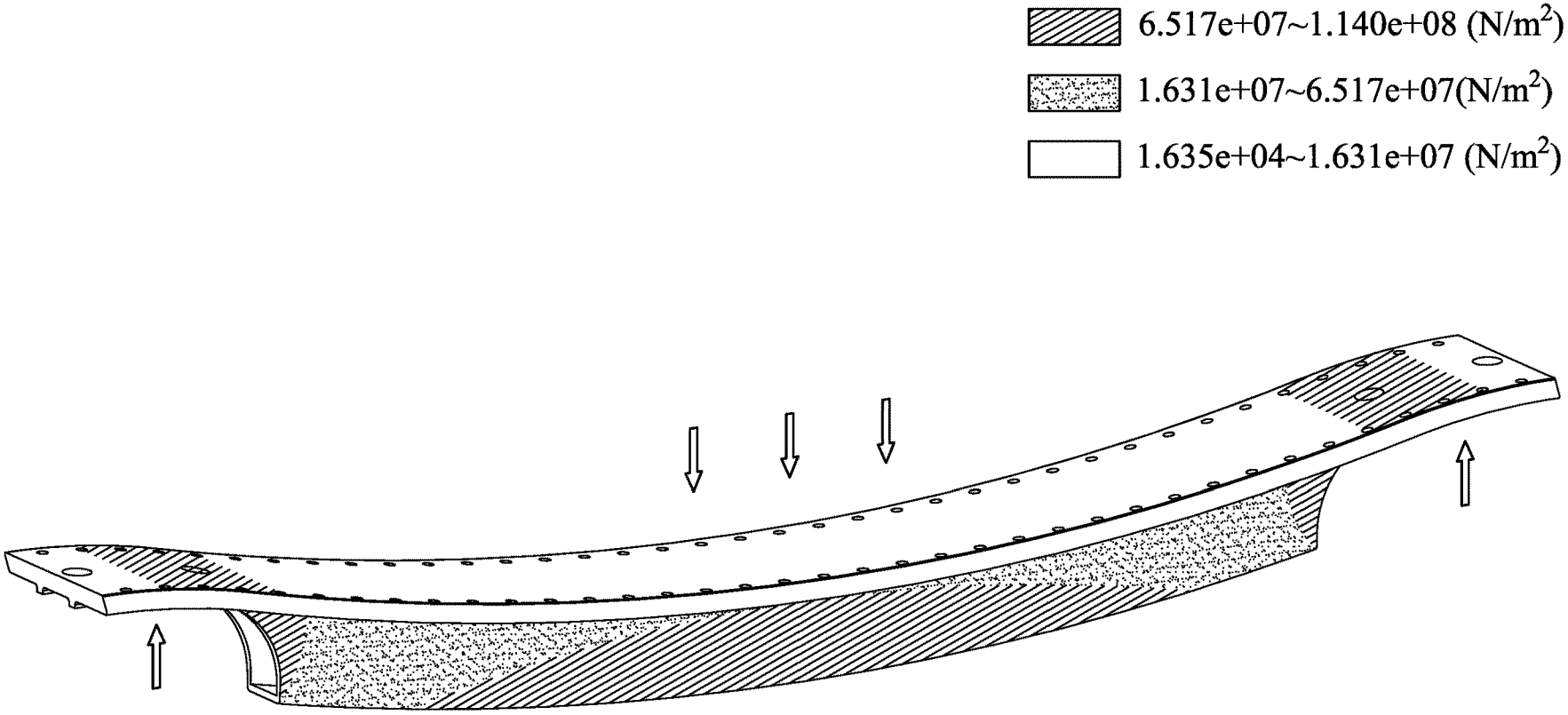
FIG. 19C is a result of the stress analysis according to the slat of the fourth embodiment of the present invention.

The structure of the hollow beam 524 of the present invention is helpful in assisting the body 522 to withstand the force applied by the user. When the user is in the normal position for use, his feet apply a force on the slat 52, so that the stress applied to the body 522 of the slat 52 is a compressive stress, and the stress applied to the bottom piece 524C of the hollow beam 524 is a tensile stress. FIGS. 19B and 19C are the results of stress analysis according to the slats in the prior art and the fourth embodiment of the present invention, respectively, wherein FIG. 19B uses a slat with two fins as a model for simulation, and FIG. 19C use a slat with a hollow beam 524 (including the first strengthening piece 524A, the second strengthening piece 524B and the bottom piece 524C) as a model for simulation. According to the results, the middle section of the bottom of each fin in FIG. 19B bears the highest stress (i.e. the tensile stress, ranging from $1.5\times10^8$-$2.3\times10^8$ Newton/$m^2$), while the hollow beam 524 structure in FIG. 19C can effectively disperse the stress on the slats 52 to make the stress to be distributed more evenly along the longitudinal direction X of the body 522, in which the highest tensile stress does not exceed $1.4\times10^8$ Newton/$m^2$. In addition, when the middle section of the bottom of the slat bears higher stress, the slat is more likely to be deformed, and thus causing a greater degree of deflection. The degree of deflection of the slat is related to the stability of the user, and it is difficult for the user who moves on a slat with a greater degree of deflection to maintain stability. Compared with the structure of the existing slats, under the same force F3, the structure of the slat 52 of the present invention prevents the stress from excessively concentrating on the middle section of the bottom of the slat 52, which makes the slat 52 less prone to breakage and also makes the user on the treadmill to have better stability. Therefore, as far as the structure of the slat is considered, the hollow beam can provide a better dispersion effect for the stress on the slat than fins.

With the hollow beam structure of the slat of the present invention, the force acting on the slat can be evenly dispersed, so that the slat is not easily deformed or broken from the center, and the weight of the hollow beam structure is lighter, which is beneficial to the rotation of the running belt formed by the slats.

It is understood, that this invention is not limited to the particular embodiments disclosed, but is intended to cover all modifications which are within the spirit and scope of the invention as defined by the appended claims, the above description, and/or shown in the attached drawings.

What is claimed is:

1. A manual treadmill, comprising:

a frame having a front support portion and a rear support portion, wherein the front support portion includes:
a front shaft with two ends fixed to the frame; and
a front sleeve rotatably coupled to the front shaft;

a running belt disposed about and supported by the front support portion and the rear support portion, wherein the running belt rotates in a first rotating direction or a second rotating direction in response to a directional movement of a user; and a speed limiting device including a one-way bearing, a rotating element and a transmission element, wherein the rotating element is coupled to the front sleeve, and the one-way bearing is connected to the rotating element via the transmission element to limit a speed of the running belt in the second rotating direction.

2. The manual treadmill as claimed in claim 1, wherein the running belt includes a plurality of slats, wherein the plurality of slats are juxtaposed in parallel.

3. The manual treadmill as claimed in claim 2, wherein the frame further includes a left peripheral side and a right peripheral side, and each of the plurality of slats is disposed across the left peripheral side and the right peripheral side.

4. The manual treadmill as claimed in claim 3, wherein each of the left peripheral side and the right peripheral side is provided with a row of bearings to maintain a curved upper surface of the running belt for the directional movement of the user.

5. The manual treadmill as claimed in claim 1, wherein the front support portion further comprises:

a pair of front pulleys, each configured at each end of the front sleeve to support the running belt; and the rear support portion comprises:

a rear shaft with two ends fixed to the frame;

a rear sleeve rotatably coupled to the rear shaft; and a pair of rear pulleys, each configured at each end of the rear sleeve to support the running belt, wherein the one-way bearing causes the transmission element through a friction therebetween to provide a restraint force to the front sleeve when the front sleeve is to rotate in the second rotating direction.

6. The manual treadmill as claimed in claim 1, wherein the first rotating direction is opposite to the second rotating direction, and a first resistance of the running belt on the second rotating direction is greater than a second resistance of the running belt on the first rotating direction.

7. The manual treadmill as claimed in claim 1, wherein the one-way bearing stops rotation when the running belt is rotated in the second rotating direction.

8. The manual treadmill as claimed in claim 1, wherein the running belt has a curved upper surface for the directional movement of the user, and a curved lower surface with respect to the curved upper surface.

9. The manual treadmill as claimed in claim 1, further comprising a plurality of supporting wheels enabling the manual treadmill to have contact with a ground.

10. A manual treadmill, comprising:

a frame having a front support portion and a rear support portion, wherein the front support portion includes:
a front shaft with two ends fixed to the frame; and
a front sleeve rotatably coupled to the front shaft;

a running belt disposed about and supported by the front support portion and the rear support portion, wherein the running belt rotates in a first rotating direction by a first force applied by a user from the front support portion toward the rear support portion, and rotates in a second rotating direction by a second force applied by the user from the rear support portion toward the front support portion; and a restraint device including a one-way bearing, a rotating element and a transmission element, wherein the rotating element is coupled to the front sleeve, the one-way bearing is connected to the rotating element via the transmission element, and the restraint device provides a restraint force to the front support portion when the running belt is to rotate in the second rotating direction, to restrain a rotation of the running belt in the second rotating direction.

11. The manual treadmill as claimed in claim 10, wherein the running belt has a curved upper surface for a movement of the user and a curved lower surface with respect to the curved upper surface, and the running belt includes a plurality of slats, wherein the plurality of slats are juxtaposed in parallel.

12. The manual treadmill as claimed in claim 11, wherein the frame further comprises a left peripheral side and a right peripheral side, each of the plurality of slats is disposed across the left peripheral side and the right peripheral side, and each of the left peripheral side and the right peripheral side is provided with a row of bearings to maintain the curved upper surface.

13. The manual treadmill as claimed in claim 10, wherein the front support portion further includes:

a pair of front pulleys, each configured at each end of the front sleeve to support the running belt; and the rear support portion comprises:

a rear shaft with two ends fixed to the frame;

a rear sleeve rotatably coupled to the rear shaft; and a pair of rear pulleys, each configured at each end of the rear sleeve to support the running belt, wherein the one-way bearing causes the transmission element through a friction therebetween to provide the restraint force to the front sleeve when the front sleeve is to rotate in the second rotating direction.

14. The manual treadmill as claimed in claim 10, wherein the first rotating direction is opposite to the second rotating direction, and a first resistance experienced by the running belt on the second rotating direction is greater than a second resistance of the running belt on the first rotating direction.

15. The manual treadmill as claimed in claim 10, wherein the one-way bearing stops rotation when the running belt is rotated in the second rotating direction, thereby a speed of the running belt in the second rotating direction is limited.

16. The manual treadmill as claimed in claim 10, further comprising a plurality of supporting wheels enabling the manual treadmill to have contact with a ground.

17. A restraint device for a slat-belt treadmill, wherein the slat-belt treadmill includes a frame having a front support portion and a rear support portion, and a running belt disposed about and supported by the front support portion and the rear support portion, wherein the front support portion and the rear support portion each includes a shaft with two ends fixed to the frame and a sleeve rotatably coupled to the shaft, the running belt rotates in a first rotating direction or a second rotating direction, and the restraint device comprising:

a rotating element disposed on the sleeve of the front support portion, and rotated with the running belt;

a one-way bearing fixed on the frame and rotated only in the first rotating direction; and a transmission element connected to the rotating element and the one-way bearing, wherein the rotating element in a first instance is stopped from rotating in the second rotating direction by the one-way bearing, or in a second instance subjects to a specific restraint force in the second rotating direction when the running belt is to rotate in the second rotating direction.

18. The restraint device as claimed in claim 17, wherein the rotating element is disposed on the sleeve of the front support portion.

19. The restraint device as claimed in claim 17, wherein the rotating element is a pulley, the transmission element is a belt, and a kinetic friction force is generated due to a relative sliding between the transmission element and the rotating element and between the transmission element and the one-way bearing when the one-way bearing stops rotation when the running belt is rotated in the second rotating direction, to restrain a rotation of the running belt and the rotating element in the second rotating direction.

20. The restraint device as claimed in claim 17, wherein the rotating element is one of a gear and a belt pulley, the transmission element is one of a chain and a cogged-belt, and a static friction force is generated between the transmission element and the rotating element and between the transmission element and the one-way bearing because the one-way bearing stops rotation when the running belt is rotated in the second rotating direction by a user, such that the running belt and the rotating element cannot freely rotate in the second rotating direction.

* * * * *